United States Patent [19]

Ikeda

[11] 4,231,551

[45] Nov. 4, 1980

[54] CAPSTAN

[75] Inventor: Mankichi Ikeda, Shimizu, Japan

[73] Assignees: Kabushiki Kaisha Ikeda Seisakusho; Sugita Sangyo Kabushiki Kaisha, both of Tokyo, Japan

[21] Appl. No.: 909,644

[22] Filed: May 25, 1978

[51] Int. Cl.[3] ..... B66D 1/30

[52] U.S. Cl. ..... 254/344; 74/804; 254/362

[58] Field of Search ..... 254/150 R, 175.5, 183; 74/804, 805, 793

[56] References Cited

U.S. PATENT DOCUMENTS

| | | | |
|---|---|---|---|
| 1,637,818 | 8/1927 | Hawkins | 254/150 R |
| 2,363,093 | 11/1944 | Sprake | 254/150 R |
| 2,508,121 | 5/1950 | McIver | 74/805 |
| 3,424,036 | 1/1969 | Colgan | 74/805 |
| 3,994,187 | 11/1976 | Milenkovic | 74/804 |

*Primary Examiner*—Robert J. Spar
*Assistant Examiner*—Kenneth Noland
*Attorney, Agent, or Firm*—Robert E. Burns; Emmanuel J. Lobato; Bruce L. Adams

[57] ABSTRACT

A capstan for towing a rope which leads a marine vessel to a berth comprises a cylindrical drum having a negative crown and around which the rope is wrapped, an electric motor and a cycloid reduction gearing which connects the drum with the motor, both the motor and gearing being disposed within the drum. The motor has a shaft disposed in alignment with the axis of the drum. The reduction gearing comprises an eccentric cam mounted on one end of the shaft, a planet gear slidably mounted around the cam, and an inner gear mounted inside the drum. The inner gear meshes with the planet gear and has a number of teeth which is greater than that of the planet gear by one or more teeth. The planet gear is formed with a plurality of circular openings which are disposed on a circle of a given radius struck from the center thereof while the motor firmly carries a plurality of pins which extend upwardly through the openings. The pins are disposed on a circle of a given radius struck from the axis thereof, and support a single bracket at their upper end. The drum is rotatably supported by a bearing which is disposed between the bracket and the drum.

4 Claims, 3 Drawing Figures

CAPSTAN

FIELD OF THE INVENTION

The invention relates to a mooring arrangement, and more particularly, to a capstan used for towing a rope which leads a marine vessel to a berth when anchoring the vessel to a berth such as quay or pier.

A capstan is mounted on the deck of the vessel or berth for towing a rope extending between the vessel and the berth, by anchoring its one end and hauling the other end thereof. As illustrated in FIG. 3, the rope is wrapped around the drum a few turns, and is manually hauled while rotating the drum. The capstan may be mounted on a quick release hook unit, thereby forming a mooring arrangement. The hook unit anchors one end of the rope in a manner to be releasable from a remote location.

DESCRIPTION OF THE PRIOR ART

Conventional capstans are typically of two kinds. In one kind, the drum, reduction gearing and motor are disposed in a longitudinal sequence so that the axis of the drum aligns with the motor axis. Normally a rigid housing is provided which receives the reduction gearing and the motor, and the drum is rotatably mounted on the housing. In the other kind, the axis of the drum is disposed at an angle of 90° from the axis of the motor, with the reduction gearing disposed at the point of intersection of these axes, thus forming an L-shaped assembly. In this instance, the reduction gearing includes a rigid housing and the motor is disposed alongside the housing while the drum is mounted on top of the housing.

With conventional capstans as described above, the drum is mounted on top of the drive unit and thus has an increased elevation, which degrades the ease of operation. To avoid such difficulty, there has been proposed the provision of a pit in the deck or berth within which the drive unit is to be received. However, this approach involves an increased installation cost and requires some means which prevents the inundation of the pit. Also, the capstan cannot be mounted on top of the hook unit with this technique. There is also known a capstan in which the drive unit is mounted on top of the drum in order to reduce the level of the drum. However, this arrangement suffers from the disadvantage that the rope may be entangled with the drive unit when wrapping it around the drum.

SUMMARY OF THE INVENTION

It is an object of the invention to provide a capstan of a compact construction in which the motor and the reduction gearing are assembled inside the drum.

It is a specific object of the invention to provide a capstan of the kind described which is simple in construction and easy to assemble.

The capstan of the invention comprises a base, a drum rotatably mounted on the base, an electric motor firmly secured to the base and disposed within the drum, a cycloid reduction gearing disposed within the drum for operatively connecting the motor with the drum, and means for rotatably mounting the drum on the base through the interposition of the motor.

The motor includes a housing comprising a lower bracket, a cylindrical sidewall and an upper bracket. The lower bracket is connected with the base and thus mounted thereon. The motor has a shaft extending in alignment with the axis of the drum and having its one end extending through the upper bracket to the outside thereof. The reduction gearing includes an eccentric cam mounted on one end of the motor shaft, a planet gear mounted to slide around the eccentric cam, and an inner gear mounted inside the drum. The planet gear meshes with the inner gear, which has a greater number of teeth than the planet gear. The planet gear is formed with a plurality of circular openings disposed on a circle of a given radius while the upper bracket of the motor carries a plurality of pins disposed on a circle of a given radius struck from the axis of the motor, the pins extending through the corresponding circular openings in the planet gear to carry a single support bracket on their upper end. The drum support means includes a first bearing disposed between the support bracket and the drum, and a second bearing disposed between the lower bracket of the motor and the drum.

In operation, as the motor rotates, the rotation of the eccentric cam causes a rotation of the planet gear simultaneously with a revolution thereof around the axis of the inner gear. The rotation of the planet gear is transmitted through the inner gear to the drum, thus rotating it.

DESCRIPTION OF PREFERRED EMBODIMENT

Figure 1:
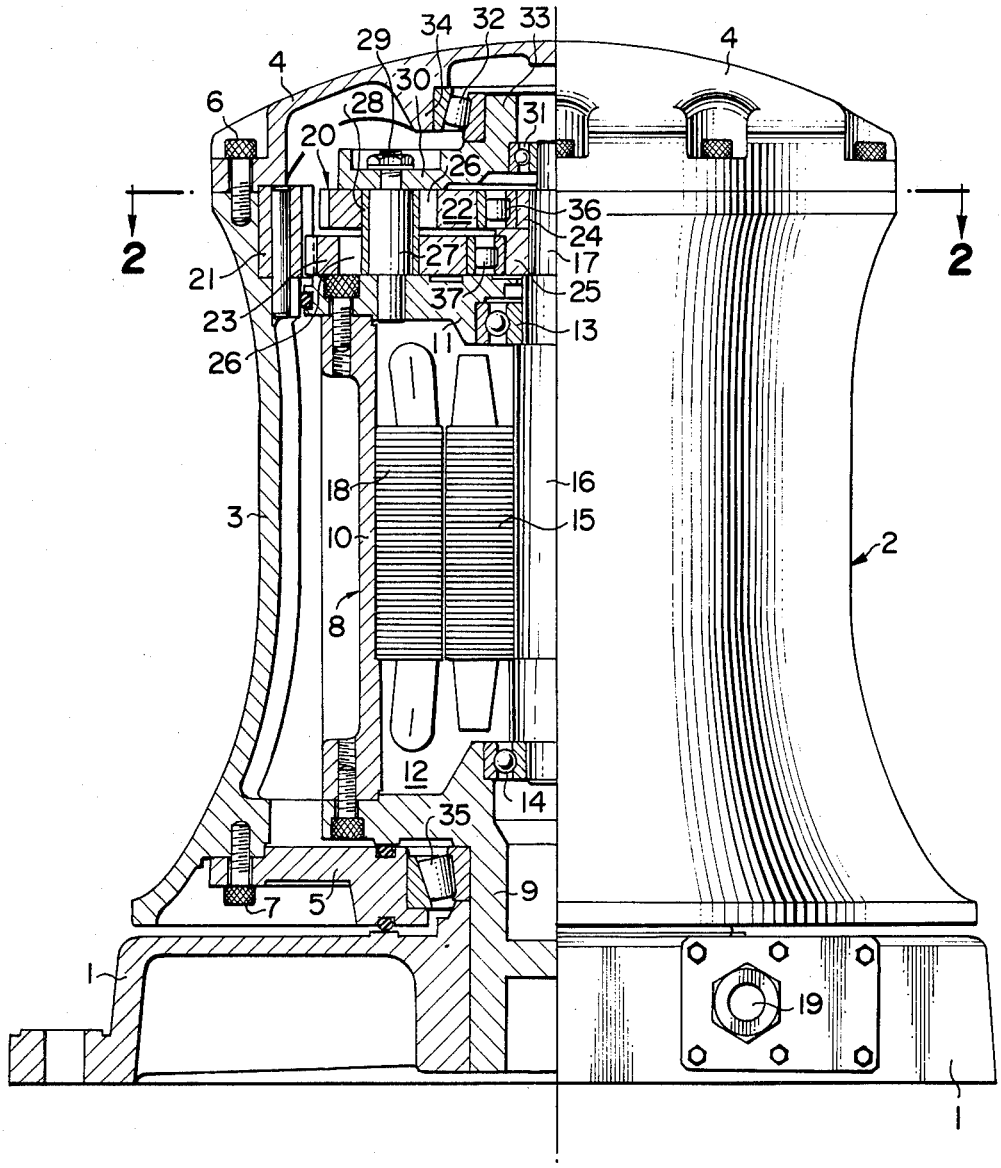
FIG. 1 is a side elevation, partly in section, of the capstan of the invention.

Referring to FIG. 1, the capstan of the invention comprises a drum 2 which is rotatably mounted on a base 1. The drum 2 includes a cylindrical drum body 3 having a negative crown, i.e. having a reduced diameter at its intermediate portion than the diameter at its opposite ends, and a top cover 4 and bottom cover 5 which are firmly secured to the opposite ends of the drum body 3 by means of screws 6, 7. An electric motor 8 is disposed within the drum, and includes a housing 12 which comprises a lower bracket 9, a cylindrical sidewall 10 and an upper bracket 11. By mounting the lower bracket 9 on the base 1, the motor is firmly mounted on the base. Both upper and lower brackets 11, 9 carry bearings 13, 14, which rotatably support a shaft 16 carrying a rotor 15. The shaft 16 is aligned with the axis of the drum 2, and has its upper end 17 extending through the upper bracket 11. The cylindrical sidewall 10 carries a stator 18, and lead wires of the motor 8 are connected with terminals 19 disposed on the base 1.

Figure 2:
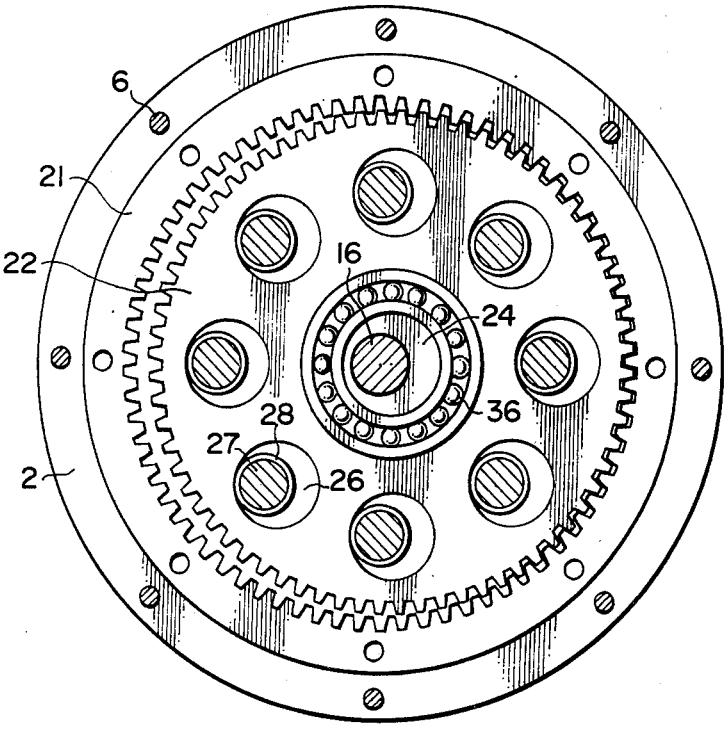
FIG. 2 is a cross section taken along the line 2—2 shown in FIG. 1.

A cycloid reduction gearing 20 is disposed within the drum 2 for operatively connecting the drum with the motor 8. In the example shown, the reduction gearing 20 comprises an inner gear 21 mounted on the inside of the drum 2, a pair of planet gears 22, 23 of an identical configuration and dimension and meshing with the inner gear. These planet gears are mounted around a pair of eccentric cams 24, 25 with bearings 36, 37 interposed therebetween. The eccentric cams are mounted on the end 17 of the motor shaft 16. The cams 24, 25 are of an identical profile, but is mounted on the shaft 16 with a phase displacement of 180° from each other. For convenience of illustration, FIG. 2 shows only one planet gear 22 and only one eccentric cam 24 in illustrating their relationship with the inner gear 21 and shaft 16. Cycloid reduction gearing is well known and therefore will not be described in detail. However, the inner gear 21 generally has a number of teeth which is by one or two teeth greater than that of the planet gears 22, 23. The rotation of the shaft 16 causes a rotation of the eccentric cams 24, 25, which in turn causes a rotation of the planet gears 22, 23 simultaneously with a revolution thereof around the axis of the inner gear 21. The rotation of the planet gears causes the rotation of the inner gear 21. The use of two planet gears 22, 23 which are phase displaced from each other by 180° stabilizes the rotation of the inner gear 21, but it should be understood that a single planet gear may be used.

Each of the planet gears 22, 23 is formed with a plurality of circular openings 26 which are disposed on a circle of a given radius struck from the center thereof. The openings 26 of the two planet gears partly overlap each other when both phase displaced gears are used in combination. The upper bracket 11 of the motor 8 firmly carries a plurality of pins 27 which extend through the overlapping portions of the circular openings 26 formed in the pair of planet gears 22, 23. These pins are disposed on a circle of a given radius struck from the axis of the motor shaft 16. Each pin 27 is provided with a rotatable sleeve 28 which is operatively engaged with the peripheral edge of the opening 26. The purpose of these sleeves is to minimize the abrasion of the tooth on the gears 21 to 23 since a slip between the planet gear and the inner gear is converted into a rolling movement. The upper end of the pins 27 is firmly connected with a common support bracket 30 by means of screws 29. The support bracket 30 carries a bearing 31 which rotatably support the end 17 of the motor shaft 17 and also carries another bearing 32 which rotatably supports the drum 2. The bearing 32 is disposed between a boss 33 of the support bracket 30 and an annular rib 34 formed on the top cover 4 of the drum 2. At its lower end, the drum 2 is also rotatably supported by a bearing 35 which is disposed between the bottom cover 5 and the lower bracket 9 of the motor 8.

Figure 3:
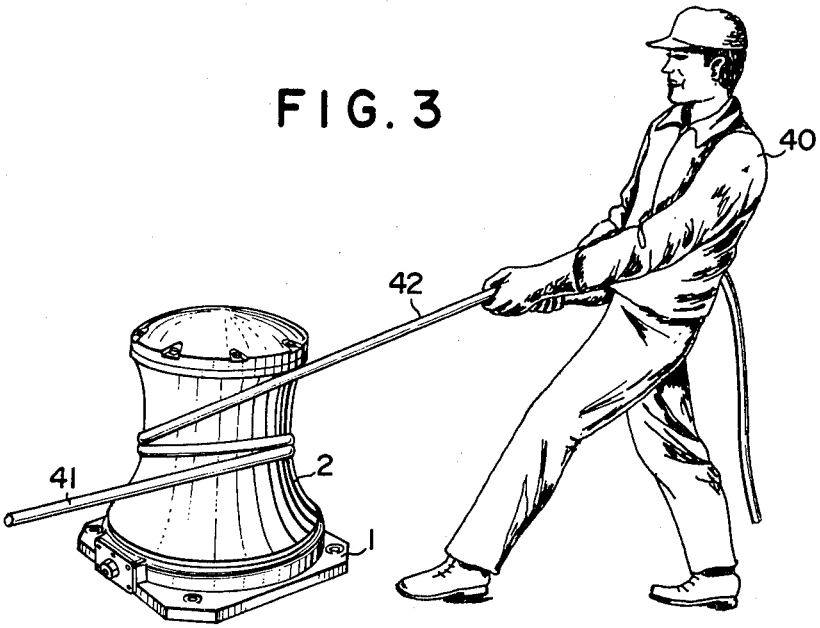
FIG. 3 is a perspective view of the capstan, illustrating its use.

FIG. 3 depicts the use of the capstan. The basement 1 is directly mounted on the deck of a marine vessel or on the berth. The basement may also be fixedly mounted on a hook unit, not shown, which is secured to the deck or berth. In either instance, the level of the drum 2 is reduced as compared with conventional capstans, thus facilitating the hauling operation by an operator 40 who pulls the free end 42 of a rope 41 wrapped around the drum 2.

What is claimed is:

1. A capstan for hauling a marine vessel by way of a rope, comprising:

a base, a motor having a housing comprising a lower bracket fixed to said base, a cylindrical wall fixed at its lower end to said lower bracket and an upper bracket fixed to the upper end of said cylindrical wall, a stator inside said cylindrical wall and a rotor having a shaft rotatably supported by a bearing in said lower bracket and a bearing in said upper bracket, an eccentric cam fixed on an upward extension of said shaft, a planet gear having teeth on its periphery, a central opening rotatably receiving said cam and a plurality of secondary openings arranged in a circle around and spaced from said central opening, a plurality of pins fixed to said upper bracket and extending up through said secondary openings in said planet gear and a support bracket fixed to upper ends of said pins, said support bracket having a central bearing rotatably supporting said upward extension of said shaft, and a drum comprising a generally cylindrical body surrounding said motor and having a negative crown, a top cover fixed to an upper end of said body and a bottom cover fixed to a lower end portion of said body, means rotatably supporting said drum comprising a lower bearing in a central opening of said bottom cover bearing on a downwardly extending central portion of said lower bracket and an upper bearing in a central recess of said top cover and bearing on an upwardly projecting central portion of said support bracket, and an internal ring gear fixed in an upper portion of said body in position to mesh with said planet gear and having at least one more teeth than said planet gear.

2. A capstan according to claim 1, in which a second eccentric cam is fixed on an upward extension of said shaft above said first mentioned cam, said second cam being phase displaced 180° from said first mentioned cam, and a second like planet gear is disposed above said first mentioned planet gear and surrounding said second eccentric cam, said second planet gear having on its periphery teeth meshing with teeth of said internal ring gear.

3. A capstan according to claim 1, in which said lower bracket and upper bracket are removably secured to said cylindrical wall of said motor.

4. A capstan according to claim 1, in which said top cover and bottom cover are removably secured to said generally cylindrical body of said drum.

* * * * *